US006306529B1

(12) United States Patent
Shimizu et al.

(10) Patent No.: US 6,306,529 B1
(45) Date of Patent: Oct. 23, 2001

(54) MINUTE STRUCTURES FOR PRODUCING COLORS AND SPINNERETS FOR MANUFACTURING SAME

(75) Inventors: Susumu Shimizu; Akio Sakihara; Kinya Kumazawa, all of Kanagawa; Hiroshi Tabata, Yokohama, all of (JP)

(73) Assignees: Nissan Motor Co., Ltd., Yokohama; Tanaka Kikinzoku Kogyo K.K., Tokyo, both of (JP)

( * ) Notice: Subject to any disclaimer, the term of this patent is extended or adjusted under 35 U.S.C. 154(b) by 0 days.

(21) Appl. No.: 08/875,739

(22) PCT Filed: Dec. 6, 1996

(86) PCT No.: PCT/JP96/03580

§ 371 Date: Aug. 4, 1997

§ 102(e) Date: Aug. 4, 1997

(87) PCT Pub. No.: WO97/21855

PCT Pub. Date: Jun. 19, 1997

(30) Foreign Application Priority Data

Dec. 8, 1995 (JP) ..... 7-345610

(51) Int. Cl.[7] ..... B41M 3/12
(52) U.S. Cl. ..... 428/913; 428/38
(58) Field of Search ..... 428/224, 38, 229, 428/407, 913; 442/301

(56) References Cited

U.S. PATENT DOCUMENTS 4,514,459 4/1985 Nakagawa et al. ..... 428/229
5,407,738 * 4/1995 Tabata et al. ..... 428/229
5,472,798 12/1995 Kumazawa et al. ..... 428/690

FOREIGN PATENT DOCUMENTS

0686858A2 * 12/1995 (EP) .
2297943A * 8/1996 (GB) .
43-14185 6/1968 (JP) .
3-57984 12/1984 (JP) .
59-228042 12/1984 (JP) .
60-24847 6/1985 (JP) .
62-170510 7/1987 (JP) .
63-120642 5/1988 (JP) .
63-64535 12/1988 (JP) .
1-139803 6/1989 (JP) .

OTHER PUBLICATIONS

Matsumoto et al., Journal of the Textile Machinery, Society of Japan, vol. 42, No. 2, pp. 55–62 (1989).

Matsumoto et al., Journal of the Textile Machinery, Society of Japan, vol. 42 No. 10, pp. 60–68 (1989).

* cited by examiner

*Primary Examiner*—Merrick Dixon
(74) *Attorney, Agent, or Firm*—Foley & Lardner

(57) ABSTRACT

A minute structure for producing a color comprises a first coloring part for producing a color with first wavelengths in the visible light area by physical actions such as reflection and Interference. The first coloring part includes lamellas disposed in layers at predetermined intervals. A second coloring part is disposed adjacent to the first coloring part for absorbing a part of light with second wavelengths in the visible light area and reflecting the rest of light. The second coloring part contains a coloring matter.

22 Claims, 13 Drawing Sheets

MINUTE STRUCTURES FOR PRODUCING COLORS AND SPINNERETS FOR MANUFACTURING SAME

BACKGROUND OF THE INVENTION

The present invention relates to minute structures for producing colors which are applied to fabrics, coating fibers and chips, etc. The present invention also relates to spinnerets for manufacturing the minute structures.

Conventionally, a method of adopting inorganic or organic dyes and pigments or scattering bright members such as aluminum and mica flakes in paints has been in general use for providing various fibers and car coatings with desired colors or improved visual quality.

Recently, with an user's tendency to a high fabric quality, etc., there are increasing demands on graceful and quality minute structures which have tones varying with a change in the angle of view and having high chromas. Some minute structures are developed and proposed to satisfy the above demands. One is such as to produce a color by reflection, interference, diffraction or scattering of light without using coloring matters such as dyes and pigments. The other is such as to produce a brighter color by combining the above optical action and the dyes and pigments.

JP 43-14185 and JP-A 1-139803 disclose coated-type composite fibers with iridescence which are made of two or more resins having different refractive indexes.

A journal of the Textile Machinery Society of Japan (Vol. 42, No. 2, pp. 55–62, published in 1989 and Vol. 42, No. 10, pp. 60–68, published in 1989) describes laminated photo-controllable polymer films for producing colors by optical interference, wherein a film with anisotropic molecular orientation is interposed between two polarizing films.

JP-A 59-228042, JP-B2 60-24847 and JP-B2 63-64535 disclose fabrics with iridescence conceived, e.g. from a South American morpho-butterfly which is well-known by its bright tone varying with a change in the angle of view.

JP-A 62-170510 and JP-A 63-120642 disclose fibers and sheetlike articles which produce interference colors due to recesses with a predetermined width formed on the surface thereof, respectively. Each document describes that formed objects are fast and permanent in color due to no use of dyes and pigments.

The minute structures as disclosed in JP 43-14185 and JP-A 1-139803 have an advantage of producing colors irrespective of the incident direction of light, but are imperfect in view of tone brightness and visual quality due to the fact that the optical thickness (geometrical thickness of a covering layer x refractive index thereof is not always constant when viewed from the incident direction of light.

The minute structure as described in the journal of the Textile Machinery Society of Japan is difficult to be formed in fine fibers and minute chips or pieces, and are still imperfect in view of tone brightness.

The minute structures as disclosed in JP-A 59-228042, JP-B2 60-24847, JP-B2 63-64535, JP-A 62-170510, and JP-A 63-120642 are difficult to give desired coloring function due to no precise teachings of the dimension thereof.

For solving such inconveniences, U.S. Pat. No. 5,407,738 and U.S. Pat. No. 5,472,798 propose new minute structures, with concrete dimension, for producing colors which have bright tones varying with a change with the angle of view by reflection and interference of light, and no change with time. The teachings of U.S. Pat. No. 5,407,738 and U.S. Pat. No. 5,472,798 are hereby incorporated by reference.

The minute structures as disclosed in U.S. Pat. No. 5,407,738, which produce colors by reflection and interference of light, i.e. when satisfying the interference condition with regard to the refractive index and thickness of two component substance layers, are inferior in diversity than the conventional minute structures comprising generally coloring matters which can produce various colors by mixing coloring matters of different kinds.

Moreover, the above minute structures, which are made of materials having optical penetrability, may be out of the coloring condition when contacting a transparent substance layer, not determined. That is, when an environment of the minute structures is determined to be an air layer, the phenomenon occurs that the above minute structures give excellent coloring function in the air layer, but do not give sufficient coloring function in an environment with no air layer.

By way of example, when clothes made of fibers of minute structure are wet with oil (refractive index n=1.34 to 1.54) or water (refractive index n=1.33), or put in a solvent, the clothes have a substance layer with different refractive index formed on the fiber surface, etc., resulting in no production of desired colors, and occasionally, an occurrence of see-through.

Therefore, an object of the present invention is to provide minute structures of high quality which produce, by reflection and interference of light, colors with various bright and clear tones and without any possible occurrence of see-through.

Another object of the present invention is to provide spinnerets for manufacturing the above minute structures.

SUMMARY OF THE INVENTION

According to one aspect of the present invention, there is provided a minute structure for producing a color, comprising:

at least one first part, said first part producing a first color with first wavelengths in a visible light area by physical actions, said first part including lamellas disposed in layers at predetermined intervals; and a second part disposed adjacent to said first part, said second part absorbing a part of light with second wavelengths in said visible light area and reflecting the rest of light, said second part containing a coloring matter.

Another aspect of the present invention lies in providing a minute structure for producing a color, comprising:

first parts, each first part producing a first color with first wavelengths in a visible light area by physical actions, each first part including lamellas disposed in layers at predetermined intervals; and a second part disposed adjacent to said first parts, said second part absorbing a part of light with second wavelengths in said visible light area and reflecting the rest of light, said second part containing a coloring matter, said first parts being radially disposed around said second part.

Still another aspect of the present invention lies in providing a spinneret for manufacturing an island-in-a-sea type filament out of first and second island-portion polymers and a sea-portion polymer, comprising:

a partition, said partition including at least one first opening for shaping the first island-portion polymer and a second opening disposed adjacent to said first opening for shaping the second island-portion polymer, said first opening including first slits disposed in layers; and passage means arranged at least at a periphery of said first opening for guiding the sea-portion polymer.

Still another aspect of the present invention lies in providing a spinneret for manufacturing an island-in-a-sea type filament out of first and second island-portion polymers and a sea-portion polymer, comprising:

a partition, said partition having first openings for shaping the first island-portion polymer and a second opening arranged adjacent to said first opening for shaping the second island-portion polymer, said first openings being disposed around said second opening, each of said first openings including first slits disposed in layers; and passage means arranged at least at a periphery of said first openings for guiding the sea-portion polymer.

The other aspect of the present invention lies in providing a minute structure for producing a color, comprising:

means for producing a first color with first wavelengths in a visible light area by physical actions, said producing means including lamellas disposed in layers at predetermined intervals; and means disposed adjacent to said producing means for absorbing a part of light with second wavelengths in said visible light area and reflecting the rest of light, said absorbing means containing a coloring matter.

A further aspect of the present invention lies in providing a spinneret for manufacturing an island-in-a-sea type filament out of first and second island-portion polymers and a sea-portion polymer, comprising:

means for defining passages for the first and second island-portion polymers, said defining means including at least one first opening for shaping the first island-portion polymer and a second opening disposed adjacent to said first opening for shaping the second island-portion polymer, said first opening including first slits disposed in layers; and means arranged at least at a periphery of said first opening for guiding the sea-portion polymer.

DETAILED DESCRIPTION OF THE INVENTION

Figure 1:
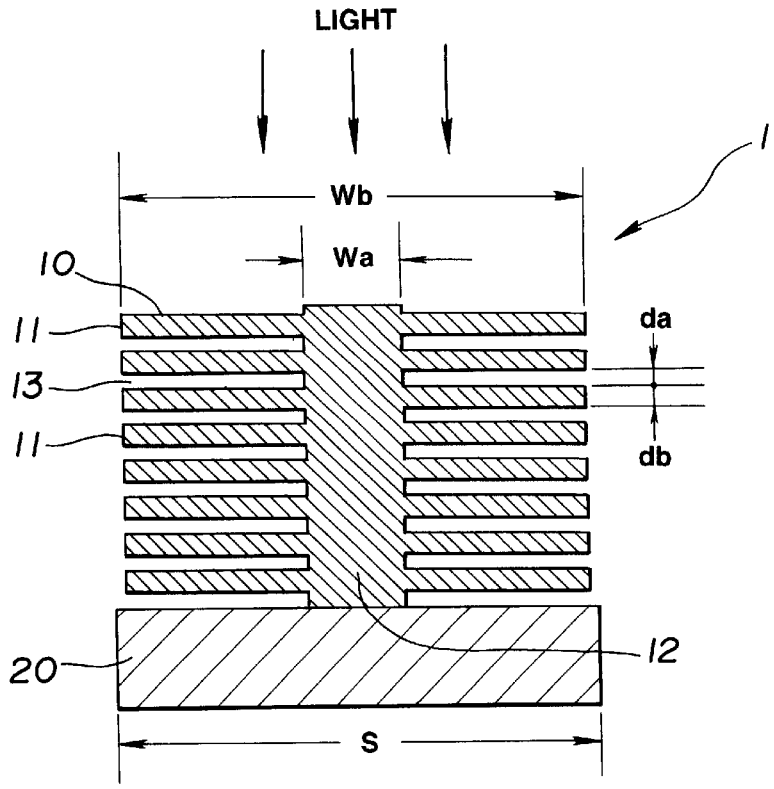
FIG. 1 is a sectional view showing a first preferred embodiment of a minute structure for producing a color according to the present invention.

Referring to the drawings, a description will be made with regard to preferred embodiments of the present invention.

FIGS. 1–6 show a first embodiment of the present invention. Referring to FIG. 1, a minute structure 1 for producing a color comprises a first coloring part 10 and a second coloring part 20 having a rectangular section and one side on which the first coloring part 10 is disposed.

The first coloring part 10, which is formed in a layer structure comprising alternate laminations of a substance layer with a predetermined refractive index and an air layer, produces a color with wavelength in a visible light area (wavelengths of 380 to 780 nm) by reflection and interference of light resulting therefrom.

A concrete structure of the first coloring part 10 may be similar to a structure as disclosed, e.g. in U.S. Pat. No. 5,407,738. Specifically, the first coloring part 10 comprises lamellas 11 disposed in layers and parallel to a surface of the second coloring part 20 and with a predetermined slit or space 13 between two adjacent lamellas 11, and a core portion 12 extending perpendicularly from the one side of the second coloring part 20 to interconnect the lamellas 11. The lamellas 11 of the first coloring part 10 have the same length, and a width substantially equal to a width S of the second coloring part 20, so that an assemblage of the first coloring part 10 and the second coloring part 20 has a substantially rectangular section.

A material for forming the first coloring part 10 is preferably a thermoplastic polymer in view of its easy forming and material values such as optical penetrability and refractive index which enable effective occurrence of reflection and interference of light. Examples of thermoplastic polymers are polypropylene (PP), polyvinylidene fluoride (PVDF), nylon, polyvinyl alcohol, polyethylene terephtalate (PET), polystyrene (PS), polymethyl methacrylate (PMMA), polycarbonate (PC), polyether etherketone, polyparaphenylene terephthalamid, polyphenylene sulfide (PPS), etc. Copolymers and mixed polymers having two or more of the above polymers are also applicable.

The layer structure of the lamellas 11 serves to not only reflect ultraviolet ray and infrared ray, but produce a color with wavelength in the visible light area by reflection and interference of light. Referring to FIG. 1, suppose that the direction of placing the lamellas 11 one upon another is a longitudinal direction of a section of the first coloring part 10, and the direction perpendicular thereto is a cross direction thereof. When the width of the core portion 12 in the cross direction is Wa, and the width of the lamellas 11 in the cross direction is Wb, the first coloring part 10 is constructed to meet the following relationship:

$$Wb \geqq 3Wa$$

Moreover, when the thickness of the slit 13 or air layer in the longitudinal direction is da, and the thickness of each lamella 11 in the longitudinal direction is db, and the refractive index of a material for forming the lamellas 11 is nb, the first coloring part 10 is constructed to meet the following relationship:

$$0.02\ \mu m \leqq da \leqq 0.4\ \mu m$$

$$0.02\ \mu m \leqq db$$

$$1.2 \leqq nb \leqq 1.8$$

and to have a dispersion of the thickness db of each lamella 11 in the longitudinal direction, i.e. a maximum value of a manufacturing error with respect to a reference value of the thickness db, being less than 40%. The above relationship meets the fundamental formula of coloring of a multilayer model comprising two substances or polymers with different refractive indexes by reflection and interference of light: $\lambda=2\ (n_a{}^s d_a+n_b{}^s d_b)$wherein $\lambda$ is a peak wavelength of reflecting spectrum, $n_a$, $n_b$ are refractive indexes of the two substances, and $d_a$, $d_b$ are thicknesses thereof (see, e.g. U.S. Pat. No. 5,472,798). That is, under such condition, a designed peak wavelength which corresponds to a tone, a greater refractive index which corresponds to a tone brightness, etc. can be obtained. It will be thus understood that coloring of the first coloring part 10 by reflection and interference of light provides a brighter tone and a higher visual quality than ordinary coloring resulting from coloring matters.

The second coloring part 20 produces a color resulting from a chromatic coloring matter. Note that, contrary to so-called black coloring matters having absorption in the whole visible light area, the chromatic coloring matter absorbs a part of light with given wavelengths in the visible light area, and reflects the rest of light. As for the definition of "chromatic color", see, e.g. Japanese Industrial Standard Z8105 "Terminology for Colors", which is incorporated herein by reference.

By way of example, when absorbing parts of light with wavelengths corresponding to both ends of the visible light area, and reflecting the rest of light with wavelengths in the vicinity of 550 nm, a green color is obtained. When absorbing a part of light with wavelengths less than 600 nm, and reflecting the rest of light with wavelengths more than 600 nm, a red color is obtained. Note that it is unpreferable to adopt dark coloring matters having lightness generally less than 4, but to adopt coloring matters having lightness more than 4, practically, more than 6. As for "dark coloring matters", see Japanese Industrial Standard Z8721 "Method of Specifying Colors by Three Attributes".

The chromatic coloring matter may be either of inorganic and organic types which produces a desired color. Moreover, practically, the chromatic coloring matter may be a pigment made of a colored powder material which is not soluble in water and most of organic solvents, or a dye made of an organic powder compound which is soluble in water and oil to disperse in single molecules which are combined with molecules of fibers, etc. to produce a color.

Examples of applicable inorganic coloring matters or pigments are oxides such as iron oxide red ($Fe_2O_3$), zinc white (ZnO) and chromium oxide ($Cr_2O_3$), hydroxides such as chrome yellow ($PbCrO_4$), viridian and alumina white, sulfides such as cadmium red (CdS.CdSe) and cadmium yellow (CdS), chromic acids such as chrome yellow and zinc chromate, etc.

Examples of applicable organic coloring matters are various azo compounds, phthalocyanine compounds, condensed polycyclic compounds such as perylene, quinacridone and thioindigo, pteridine compounds, etc. As will be described later, when using a thermoplastic polymer as a component material, the chromatic coloring matter is preferably of the organic type in view of not only dispersiibility and colorability, but spinnability. In this case, one of the organic coloring matters is selected which can fully resist a forming temperature (or decomposition temperature) of the thermoplastic polymer.

A material for forming the second coloring part 20 is not specified particularly. However, as will be described later, when integrally forming the minute structure 1, the second coloring part 20 is preferably made of a thermoplastic polymer in the same way as the first coloring part 10, and is manufactured, e.g. according to a composite spinning method. The second coloring part 20 can be obtained by adding a proper amount of one of the above coloring matters to the thermoplastic polymer. Alternatively, the second coloring part 20 can be obtained by placing or printing an ink-like coloring matter on the thermoplastic polymer.

Figure 2:
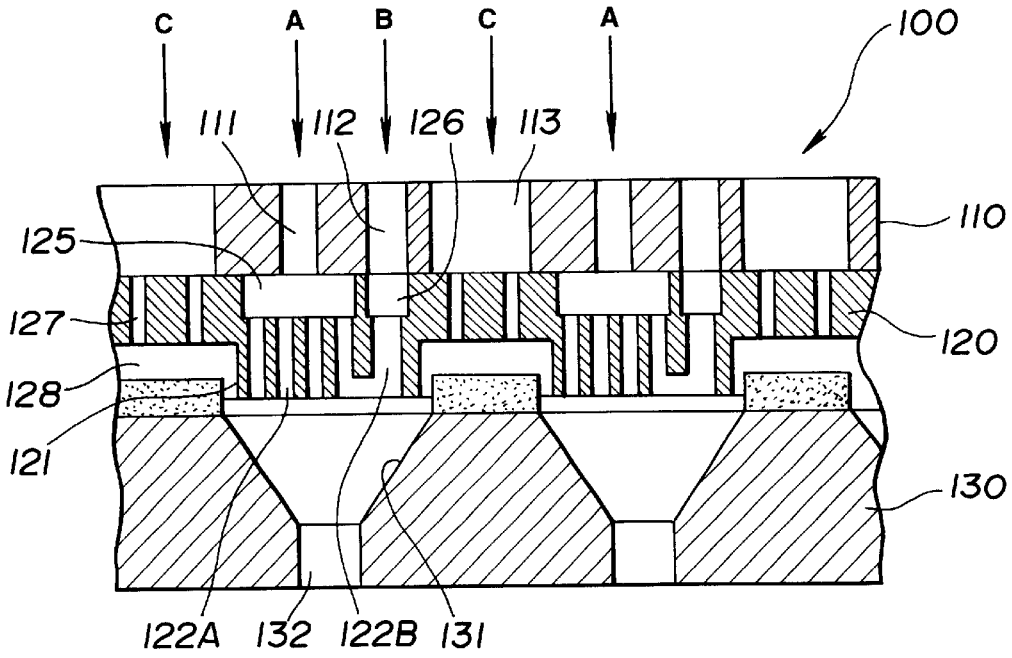
FIG. 2 is a view similar to FIG. 1, showing a melt spinning device.

Referring next to FIG. 2, a description will be made with regard to a melt spinning device 100 for manufacturing the minute structure 1.

The melt spinning device 100 comprises a spinneret 120 held between a first block 110 and a second block 130. Supplied independently to the spinneret 120 are a first island-portion polymer A as a material of the first coloring part 10, a second island-portion polymer B as a material of the second coloring part 20, and a sea-portion polymer C as a material for surrounding an island portion consisting of the first and second coloring parts 10, 20. The three polymers A, B, C are joined to each other on the extrusion side of the spinneret 120, which is then reduced in diameter through a funnel-shaped portion 131 of the second block 130, and is taken out, as an island-in-a-sea type filament, from an outlet 132 of the melt spinning device 100. This filament is wound on a take-up device, not shown.

The first block 110 is formed with supply passages 111, 112, 113 for independently leading to the spinneret 120 the two island-portion polymers island-portion polymers A, B, and the sea-portion polymer C. In order to enable simultaneous forming of island-in-a-sea type fibers, the spinneret 120 comprises sets of parallel partitions 121 for controlling islandportion passages as will be described later. The first and second block 110, 130 comprise sets of corresponding supply passages 111, 112, 113 and funnel-shaped portions 131.

Figure 3A:
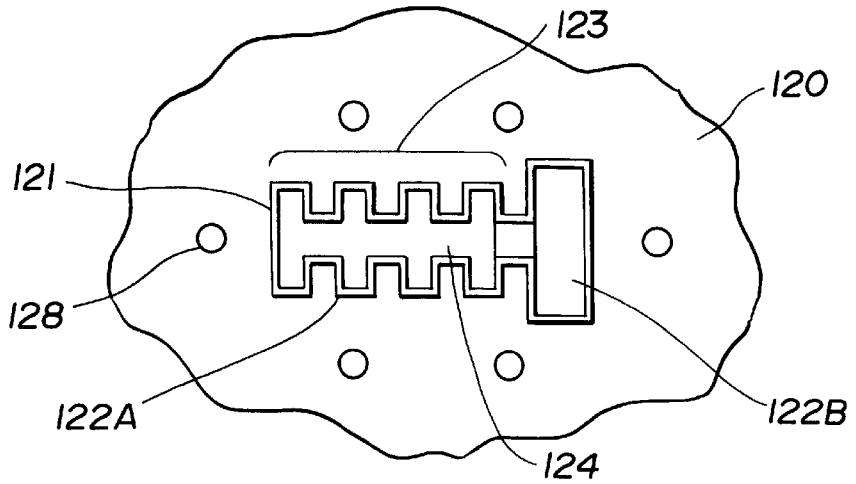
FIG. 3A is a bottom view showing a spinneret of the melt spinning device.
Figure 3B:
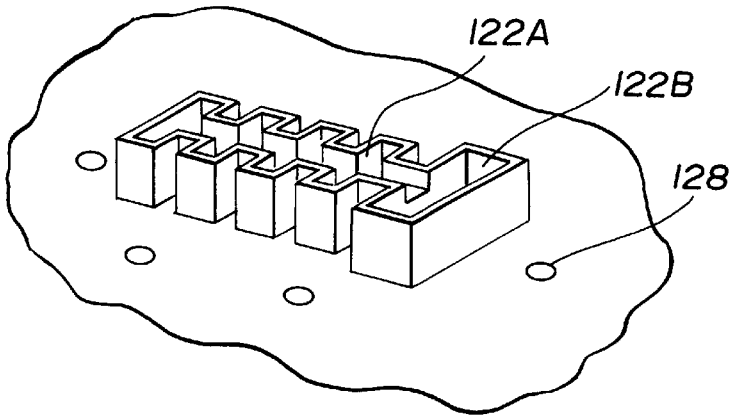
FIG. 3B is a perspective view showing a polymer extrusion side of the spinneret.
Figure 3C:
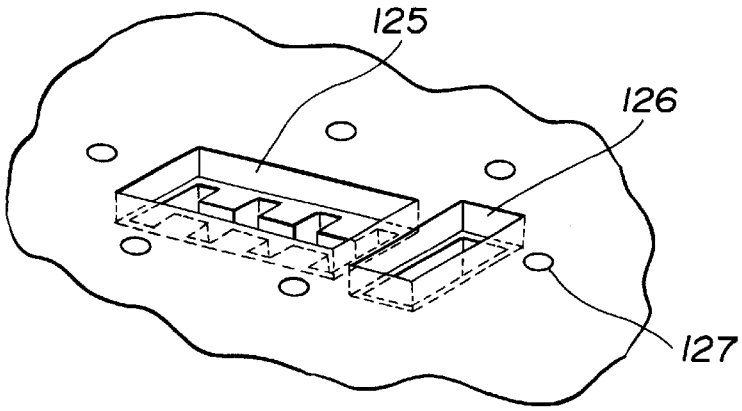
FIG. 3C is a view similar to FIG. 3B, showing a polymer receiving side of the spinneret.

Referring to FIGS. 3A–3C, the spinneret 120 will be described in detail. As best seen in FIGS. 3A and 3B, the spinneret 120 comprises, on the extrusion side thereof facing the second block 130, a partition 121 for defining two island portions through openings 122A, 122B. The opening 122A of the partition 121 through which the first island-portion polymer A passes has first slits 123 arranged parallel to each other, and a second slit 124 arranged perpendicular thereto for interconnecting the first slits 123. The opening 122B of the partition 121 through which the second island-portion polymer B passes is shaped to have a rectangular portion arranged parallel to an outer one of the first slits 123. The openings 122A, 122B of the partition 121 communicate with each other in the vicinity of an extrusion side end thereof. The slits 123, 124 are adapted to correspond with the desired configuration of the lamellas, core portion, and rectangular portion of the minute structure to be produced therewith.

Referring to FIGS. 2 and 3C, the spinneret 120 is formed, on the intake side thereof facing the first block 110, with polymer receiving portions 125, 126 corresponding to the supply passages 111, 112 for the first and second island-portion polymers A, B. Each polymer receiving portion 125, 126 is shaped like a rectangle to cover an outer periphery of the corresponding opening 122A, 122B of the partition 121, communicating with the corresponding opening 122A, 122B. Moreover, the spinneret 120 is formed, on the extrusion side thereof, with a supply passage 128 which communicates with intake passages 127 corresponding to the supply passage 113 for the sea-portion polymer C.

Referring to FIG. 2, the second block 130 comprises a funnelshaped portion 131 having outlet 132 with small diameter with respect to the shape of the openings 122A, 122B of the partition 121. The diameter of an inlet of the funnel-shaped portion 131 is determined to cover the partition 121, and communicate with the supply passage 128 at least at the periphery of the opening 122A through which the first island-portion polymer A is introduced.

The second island-portion polymer B has a coloring matter added. The first island-portion polymer A proceeds from the supply passage 111 of the first block 110 to the polymer receiving portion 125 of the spinneret 120, then to the opening 122A with layer portion 123 of the partition 121. The second island-portion polymer B proceeds from the supply passage 112 of the first block 110 to the polymer receiving portion 126, then to the opening 122B with rectangular portion of the partition 121. On the other hand, the sea-portion polymer C proceeds from the supply passage 113 of the first block 110 to the intake passages 127 of the spinneret 120, then to the supply passage 128 thereof.

The first island-portion polymer A extruded from the opening 122A form lamellas 11 interconnected by the core portion 12, whereas the second island-portion polymer B extruded from the opening 122B form rectangular portion or second coloring part 20 connected to the core portion 12. The sea-portion polymer C extruded from the supply passage 128 surrounds the lamellas 11 and rectangular portion to form a circular section composite. The circular section composite enters the funnel-shaped portion 131 of the second block 130 to undergo a diameter reduction with the sectional shape kept in a similar figure, which is taken out, as an island-in-a-sea type filament, from the outlet 132 of the melt spinning device 100.

The sea-portion polymer C is dissolved by a solvent for its removal from the island-in-a-sea type filament, obtaining the fiber-like minute structure 1 consisting of the first coloring part 10 of the first island-portion polymer A and the second coloring part 20 of the second island-portion polymer B only.

The operation of the first embodiment will be described. In the state that an air layer is placed around the first coloring part 10, light incident on the first coloring part 10 produces a color with wavelength determined in accordance with the coloring dimension or interference condition. If reflection on the first coloring part 10 is a total reflection, light does not reach the second coloring part 20, so that only the first coloring part 10 is active in coloring, producing a bright tone and a characteristic visual quality.

On the other hand, if reflection on the first coloring part 10 is not a total reflection, but, e.g. approximately 50% in reflectivity, a part of the rest of light forms stray light such as scattered light, and another part of the rest of light penetrates the first coloring part 10, and reaches the second coloring part 20 for reflection and emission with wavelengths proper to a chromatic coloring matter thereof. Thus, viewer's eyes perceive a "compound color" of a color derived from the first coloring part 10 and a color derived form the second coloring part 20. This "compound color" is due to synergistic effect of coloring of the first coloring part 10 based on interference of light and that of the second coloring part 20, having a bright and deep tone, and a characteristic visual quality which cannot be obtained by so-called ordinary colors resulting from coloring matters.

Specifically, when the wavelengths or reflection spectrum of light emitting from the first coloring part 10 correspond to those of light emitting from the second coloring part 20, an extremely bright and deep tone is obtained due to synegistic effect of the two. Moreover, when the wavelengths or reflection spectrum of light emitting from the first coloring part 10 do not correspond to those of light emitting from the second coloring part 20, a compound color is obtained which cannot be realized by the first coloring part 10 only. Even if the first coloring part 10 produces no color due to some change in conditions, the second coloring part 20 produces a color, preventing total colorlessness.

Thus, individual control of colors of the first and second coloring parts 10, 20 enables production of various colors or compound colors. If the first and second coloring parts 10, 20 produce both, e.g. blue, an output color is blue. Moreover, referring to FIG. 4A, a synegistic effect of the two not only produces an effect similar to improved reflectivity, but contributes to an improvement of deepness corresponding approximately to the reflectivity.

Figure 4A:
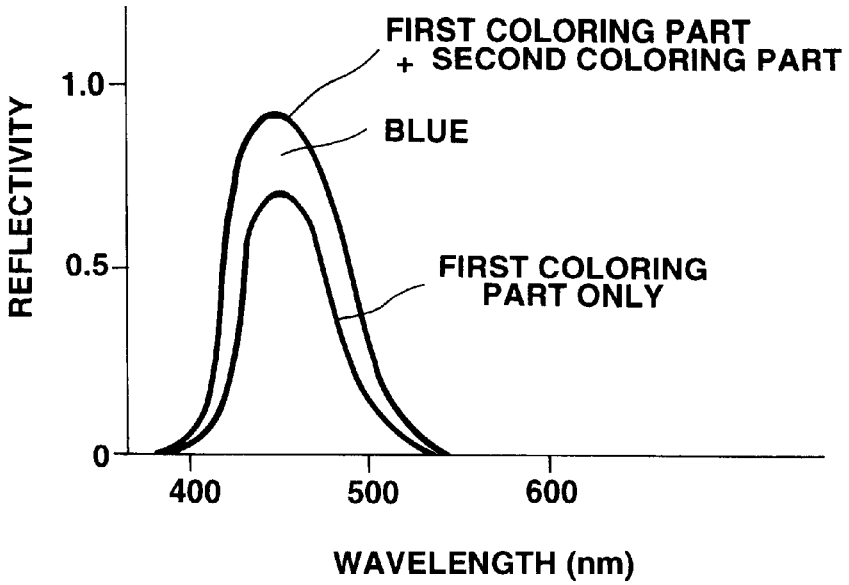
FIGS. 4A and 4B are graphs illustrating production of a compound color.
Figure 4B:
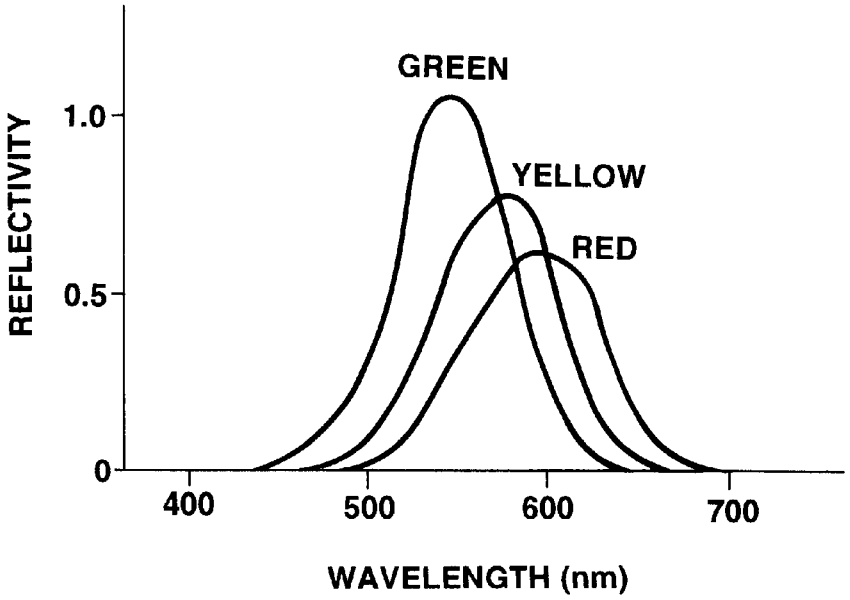

Further, if the first coloring part 10 produces green, while the second coloring part 20 produces red, an output color or compound color is generally yellow. Referring to FIG. 4B, a reflection spectrum shows that yellow is obtained from production of green and that of red. Furthermore, if the first coloring part 10 produces green, while the second coloring part 20 produces blue, an output color or compound color is generally cyan. These phenomena are explained by the three principles of colors or additive mixture of colors. In the former case, due to lack of blue of the three principles consisting of red, green and blue, yellow or complementary color of blue is seen. In the latter case, due to lack of red of the three principles, cyan or complementary color of red is seen.

On the other hand, coloring of the conventional coloring matters is carried out in accordance with subtractive mixture of colors. In case of oil colors or watercolors, for example, when mixing yellow and magenta appropriately, red is obtained; when mixing cyan and yellow appropriately, green is obtained; and when mixing yellow, magenta and cyan, black is obtained.

It is understood that the minute structure 1 produces a color in accordance with additive mixture of colors, and not subtractive mixture thereof.

Note that the first coloring part 10 only needs to produce a color with wavelength in the visible light area by one of the physical actions such as reflection, interference, diffraction and scattering of light, or a combination of two or more thereof. Also note that light is not specified particularly, and may be natural light of the sun, moon, etc., or artificial light of fluorescent, xenon and mercury lamps.

Consideration will be made with regard to the case that a transparent substance layer with refractive index different from that of the air layer is placed around the minute structure 1. In this case, due to divergence of the optical thickness (geometrical thickness of a substance layer x refractive index thereof) from a set value, the first coloring part 10 is out of the interference condition, not only producing no desired color, but allowing most of incident light to reach the second coloring part 20 according to the condition.

However, when reaching the second coloring part 20, light is reflected thereby with wavelengths proper to a coloring matter contained therein, which is perceived by viewer's eyes as a color proper to a chromatic coloring matter. Therefore, even when contacting a transparent substance with different refractive index, the minute structure 1 has no see-through due to existence of the second coloring part 20.

Note that a maximum reflection peak value or reflectivity R of the reflection spectrum of the second coloring part 200 is more than 40%, preferably, more than 60% in view of color perceptibility of viewer's eyes. This corresponds approximately to the lightness more than 4 as described above. Thus, the amount of chromatic coloring matter contained in the second coloring part 20 is adjusted so that the reflectivity or maximum reflection peak value R of the second coloring part 20 is more than 40%. In such a way, even when contacting a transparent substance with different refractive index, the minute structure 1 has no see-through due to existence of the second coloring part 20.

According to its application, etc., the minute structure 1 may have a sea-portion polymer C positively left without being removed from an island-in-a-sea type filament manufactured by the melt spinning device 100.

An example of manufacturing the minute structure 1 will be described. The following materials are prepared: pellets of polyethylene terephtalate (PET; refractive index n=1.56) for the first coloring part 10, pellets of polyethylene terephtalate containing as a chromatic coloring matter copper phthalocyanine (blue) of an organic coloring matter for the second coloring part 20, and pellets of polystyrene (PS) for the sea-portion material for holding the first and second coloring parts 10, 20. The melt spinning device 100 is used for spinning. Spinning is carried out at a spinning temperature of 280° C. and a winding speed of 6,000 m/min. Then, the sea-portion polymer C is removed from an island-in-a-sea type filament as obtained by a solvent of methyl ethyl ketone (MEK), obtaining the minute structure 1 with sectional shape as shown in FIG. 1. The thicknesses of a PET layer and air layer of the minute structure 1 are 0.08 $\mu$m and 0.16 $\mu$m, respectively. The total number of layers is 15 (PET: 8; air: 7).

A color of the minute structure 1 is evaluated in the air and the water. Upon evaluation in the air, the minute structure 1 is disposed as shown in FIG. 1 with respect to light, a reflection spectrum of which is measured at an incident angle of 0° and a receiving angle of 0° by a microspectrophotometer of Model U-6000 manufactured by Hitachi, Co., Ltd. Upon evaluation in the water, the coloring condition of the minute structure 1 is observed visually.

The results of evaluation are as follows. In the air, with the reflectivity of 90%, the reflection spectrum is obtained having a peak at wavelength of 0.48 $\mu$m, producing deep blue. The tone and deepness of this blue is clearly different from those of blue coloring by reflection and interference of light only, having a high visual quality. In the water, the minute structure 1 also produces blue with no occurrence of see-through.

In such a way, according to the first embodiment, the minute structure 1 produces a color having various bright, clear and deep tones, and a characteristic visual quality with no occurrence of see-through when contacting a transparent substance with different refractive index.

Note that the shape and size of the second coloring part 20 are not specified particularly, and may be selected optionally without lowering an effect of the first coloring part 10. Likewise, the size and number of the first coloring part 10 may be determined appropriately. Also note that, when the minute structure 1 serves as a fabric and a bright member, the flatness (transverse length/longitudinal length) of the minute structure 1 is preferably more than 3 so that the first coloring part 10 is disposed in the incident direction of light as stably as possible.

Figure 5:
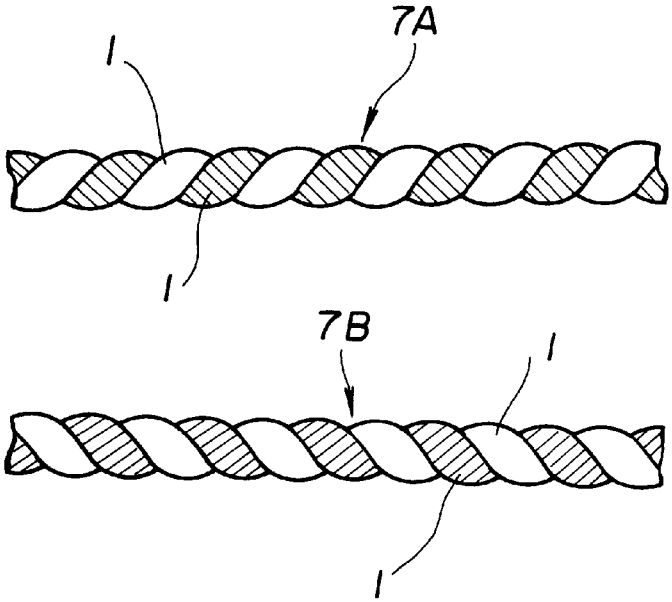
FIG. 5 is a diagrammatic view showing twisted yarns using the minute structure.

The minute structure 1 can be used to form a twisted yarn or fabric. Specifically, two or more minute structures 1 as single yarns are twisted to form a twisted yarn. Referring to FIG. 5, twisted yarns 7A, 7B are obtained by carrying out S twist of two minute structures 1 and Z twist thereof, respectively. A pitch of the minute structures 1 when forming a twisted yarn and a manner of twisting such as S twist or Z twist are determined appropriately in accordance with the size and shape of the minute structure 1. Note that two or more first coloring parts 10 and known structures or ordinary single yarns may be twisted to obtain a twisted yarn.

In order to obtain a bright tone and a characteristic visual quality of the minute structure 1, the first coloring part 10 should be arranged in the incident direction of light. With such twisted yarn of the minute structures 1, even if a plane of incidence having the first coloring part 10 is disposed only one side of the second coloring part 20, this plane surely faces on the side of light at predetermined intervals. Thus, with increased frequency of facing in the incident direction of light, a twisted yarn of the minute structures 1 produces the above tone and visual quality.

Figure 6:
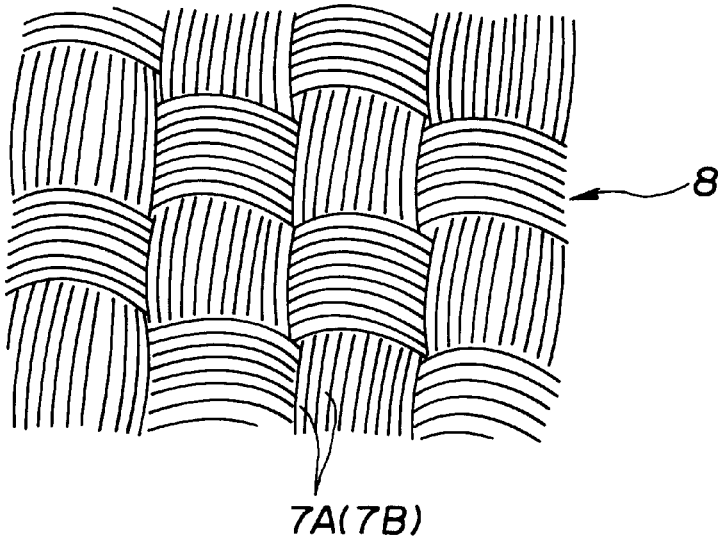
FIG. 6 is a view similar to FIG. 5, showing a fabric using the minute structure.

Referring to FIG. 6, a fabric 8 such as plain weave can be formed out of a twisted yarn of the minute structures 1. The fabric 8 formed out of the twisted yarns 7A, 7B produces a bright, clear and deep tone, and a characteristic visual quality, and is excellent in practical use due to possible maintaining of its effect even when contacting or being wet with a substance with different refractive index such as a solvent, oil and water.

Figure 7:
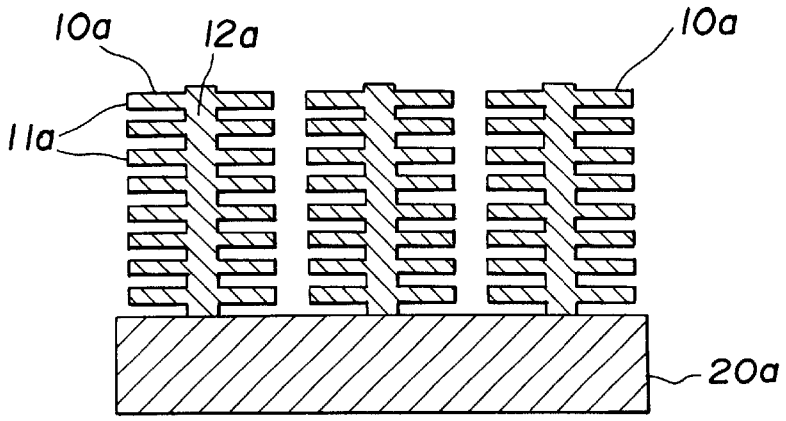
FIG. 7 is a view similar to FIG. 2, showing a variant of the first preferred embodiment.

FIG. 7 shows a variant of the first embodiment. The structure of this variant is substantially the same as that of the first embodiment of FIG. 1. In this variant, three first coloring parts 10*a* are connected to a second coloring part 20*a*. In the same way as the first coloring part 10, each first coloring part 10*a* comprises lamellas 11*a* disposed in layers, and a core portion 12*a* extending perpendicularly through the lamellas 11*a* and having an end connected to the one side of the second coloring part 20*a*. According to this variant, an arrangement of a plurality of first coloring parts 10*a* contributes to increased density of portions for carrying out reflection and interference of light, obtaining a deeper tone and a higher visual quality.

Figure 8A:
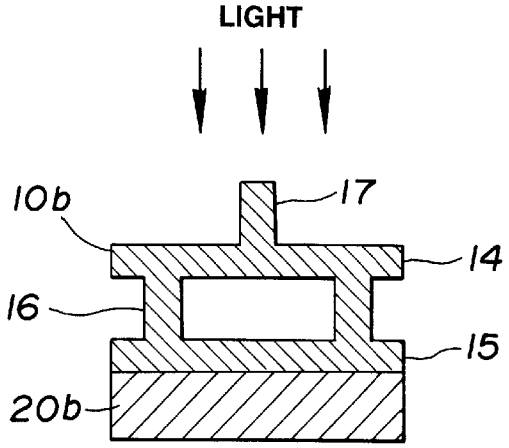
FIGS. 8A and 8B are views similar to FIG. 7, showing another variant of the first preferred embodiment.
Figure 8B:
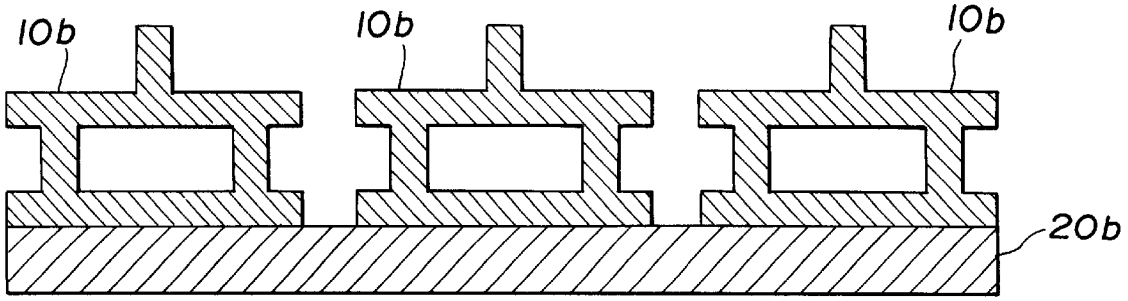

FIGS. 8A and 8B show another variant of the first embodiment. Referring to FIG. 8A, a first coloring part 10*b* made of a thermoplastic polymer with a predetermined refractive index comprises two parallel lamellas 14, 15, and two connections 16 for interconnecting the lamellas 14, 15 to form a box-like structure. The lamella 14 is provided with a protrusion 17 which outwardly perpendicularly protrudes from a center portion thereof. Each connection 16 is disposed inwardly from an end of the lamellas 14, 15 by a predetermined amount. The first coloring part 10*b* is connected to a second coloring part 20*b* through the lamella 15 joined to the entirety of one side of the second coloring part 20*b*.

According to this variant, though simple in sectional shape, the first coloring part 10*b* for producing a color resulting from its layer structure can produce the same effect as those of FIGS. 1 and 7 through interaction with the second coloring part 20*b* for producing a color resulting from a chromatic coloring matter. Referring to FIG. 8B, an arrangement of a plurality of first coloring parts 10*b* on the second coloring part 20*b* contributes to a further increase in coloring effect.

Figure 9A:
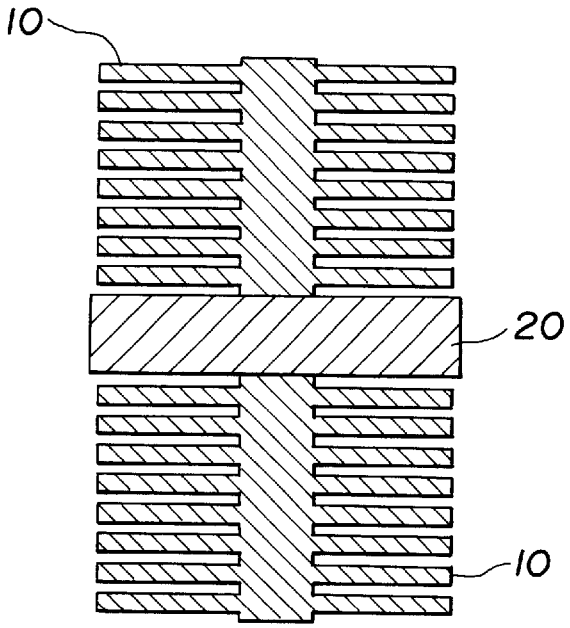
FIGS. 9A and 9B are views similar to FIG. 8B, showing the other variant of the first preferred embodiment.
Figure 9B:
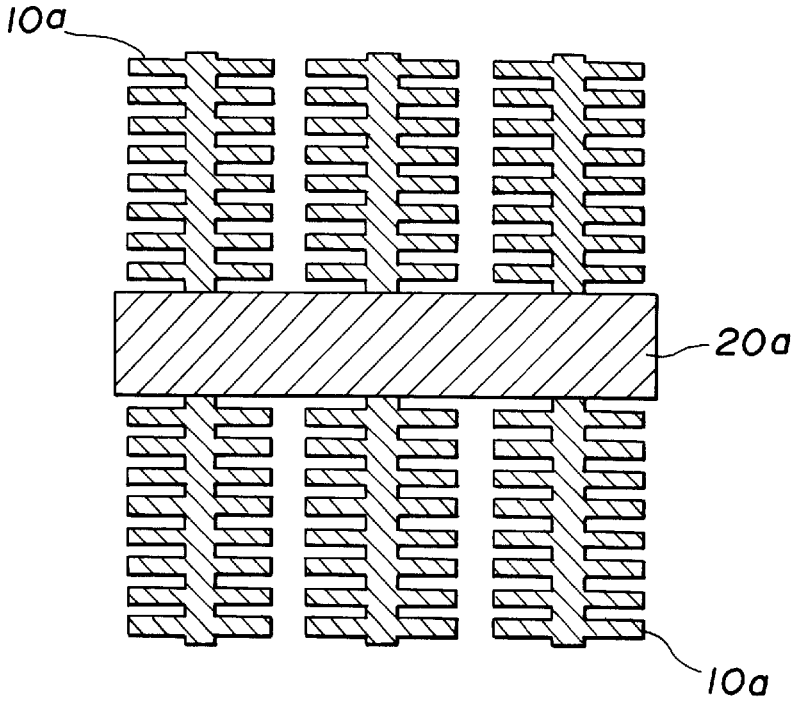

FIGS. 9A and 9B show the other variant of the first embodiment. Referring to FIG. 9A, two first coloring parts 10 are disposed on both sides of the second coloring part 20, each part being the same as a corresponding part of FIG. 1. Referring to FIG. 9B, two sets of three first coloring parts 10*a* are disposed on both sides of the second coloring part 20*a*, each part being the same as a corresponding part of FIG. 7. According to this variant, a light active side of this minute structure is not only one side thereof, so that a twisted yarn of this minute structure always ensures a deep tone and a high visual quality by reflection and interference of light regardless of the angle of view.

The above variants can be formed by changing the shape of the openings 122A, 122B of the partition 121 of the melt spinning device 120 as shown in FIGS. 3A–3C.

Figure 10:
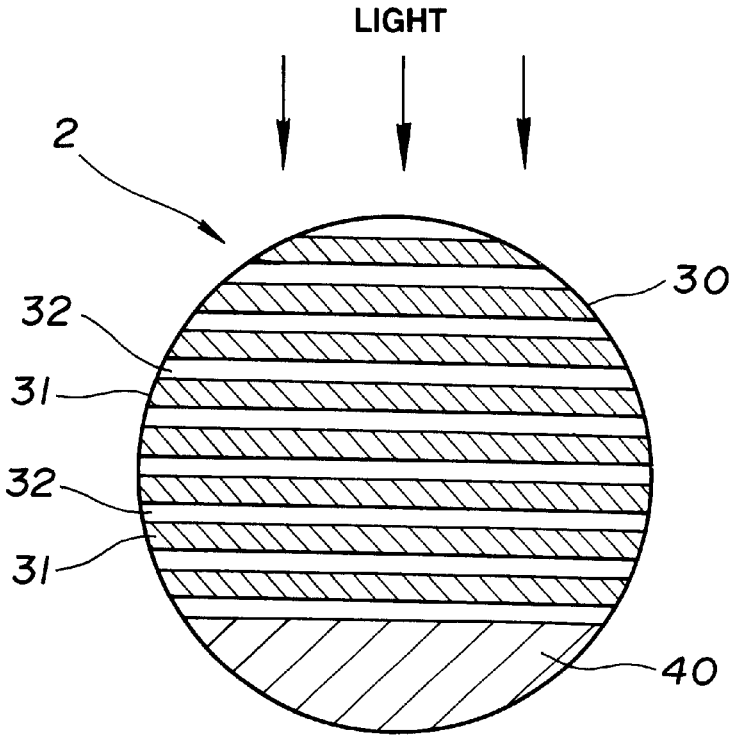
FIG. 10 is a view similar to FIG. 9B, showing a second preferred embodiment of the present invention.

FIG. 10 shows a second embodiment of the present invention. A minute structure 2 for producing a color comprises a first coloring part 30, and a second coloring part 40 defined by an arc surface and a flat surface on which the first coloring part 30 is disposed. The first coloring part 30 is formed in a layer structure comprising alternate laminations of substance layers 31, 32 with predetermined refractive indexes. A concrete structure of the first coloring part 30 may be similar to a structure as disclosed, e.g. in U.S. Pat. No. 5,472,798. Specifically, when the refractive index of the substance layer 31 is na, and the refractive index of the substance layer 32 is nb, the first coloring part 30 is constructed to meet the following relationship:

$$1.3 \leqq na$$

$$1.1 \leqq nb/na \leqq 1.4$$

The substance layers 31, 32 are made of preferably a thermoplastic polymer in the same way as in the first embodiment. Moreover, the second coloring part 40 contains a chromatic coloring matter in the same way as the second coloring part 20 in the first embodiment. The first coloring part 30 as formed in a layer structure has an arc surface which is continuous with the arc surface of the second coloring part 40, forming a circular section as a whole. Thus, the minute structure 2 produces a color with wavelength in the visible light area by reflection and interference of light based on lamination of the substance layers 31, 32 with different refractive indexes.

An example of manufacturing the minute structure 2 will be described. The following materials are prepared: pellets of poly vinylidene fluoride (PVDF; refractive index n=1.41) and polystyrene (PS; refractive index n=1.60) for the first coloring part 30, and pellets of polystyrene containing as a chromatic coloring matter an organic coloring matter or lake red C (red) for the second coloring part 40.

Used for spinning is a melt spinning device with a spinneret for enabling a diameter reduction of the above three melt polymers which join each other therein. Spinning is carried out at a spinning temperature of 200° C. and a winding speed of 5,000 m/min, obtaining the fiber-like minute structure 2 with sectional shape as shown in FIG. 10. The thicknesses of a PVDF layer and PS layer of the minute structure 2 are 0.08 μm and 0.09 μm, respectively. The total number of layers is 41 (PVDF:21; PS : 20).

This melt spinning device, not shown, only needs a spinneret having slits for PVDF and PS alternately arranged and a partly arc-shaped opening which correspond to the openings 122A, 122B for the first and second island-portion polymers A, B of the spinneret 120 of the melt spinning device 100 as described in connection with the first embodiment, and which have a periphery shaped like a circle. This melt spinning device needs no system for the sea-portion polymer C.

A color of the minute structure 2 is evaluated in the air and the water. Upon evaluation in the air, the minute structure 2 is disposed as shown in FIG. 10 with respect to light, a reflection spectrum of which is measured at an incident angle of 0° and a receiving angle of 0° by a microspectrophotometer of Model U-6000 manufactured by Hitachi, Co., Ltd. Upon evaluation in the water, the coloring condition of the minute structure 2 is observed visually.

The results of evaluation are as follows. In the air, with the reflectivity of 70%, yellow with deepness is observed which is a compound color of a color (green; dominant wavelength λ=0.52 μm) derived from the first coloring part 30 and a color (red; dominant wavelength λ=0.65 μm) derived from the second coloring part 40. In the water, the minute structure 2 produces red with no occurrence of see-through.

Figure 11:
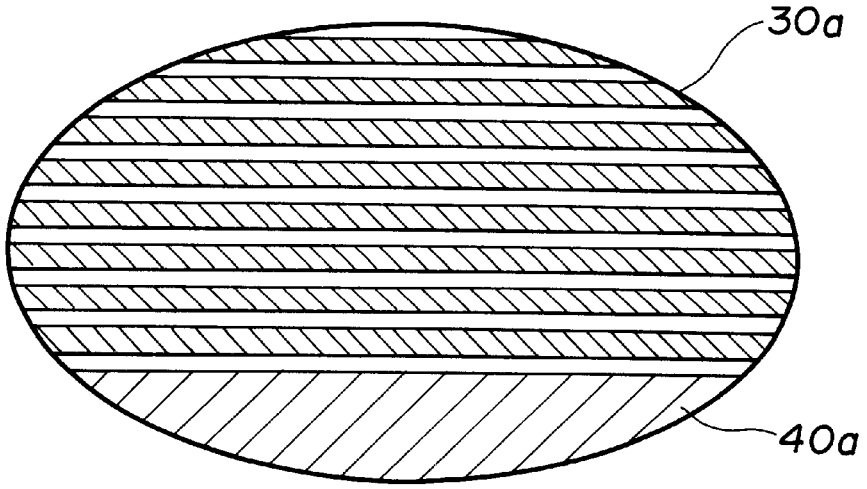
FIG. 11 is a view similar to FIG. 10, showing a variant of the second preferred embodiment.

FIG. 11 shows a variant of the second embodiment. In this variant, a first coloring part 30*a* formed in a layer structure is disposed on a second coloring part 40*a* to form an elliptical or oval section as a whole. According to this variant, the width of the first coloring part 30*a* is increased to enlarge the area of the layer structure for carrying out reflection and interference of light, resulting in an advantage of further improved depth of the color.

Figure 12A:
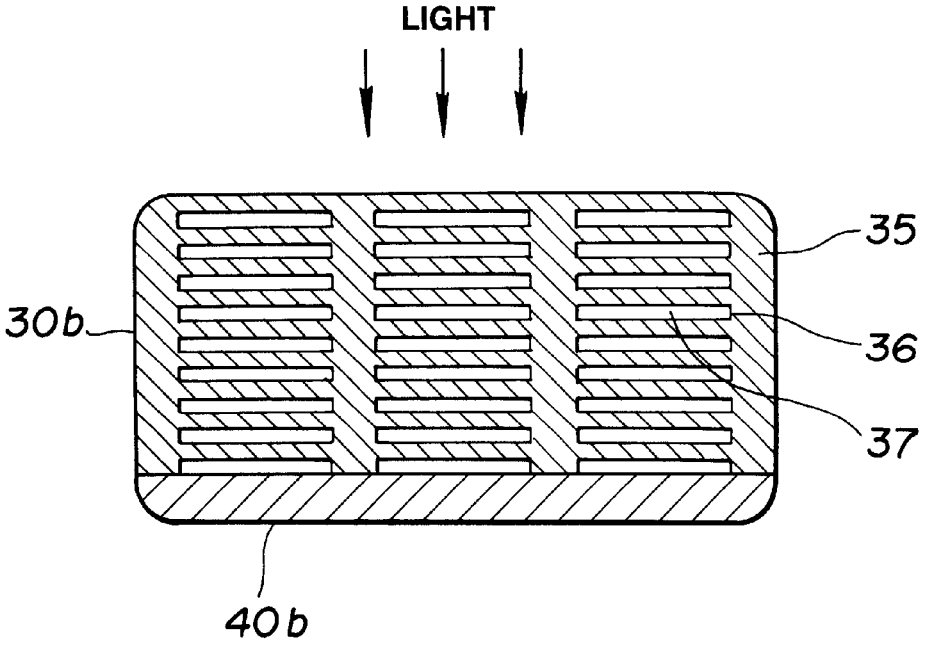
FIGS. 12A and 12B are views similar to FIG. 11, showing another variant of the second preferred embodiment.
Figure 12B:
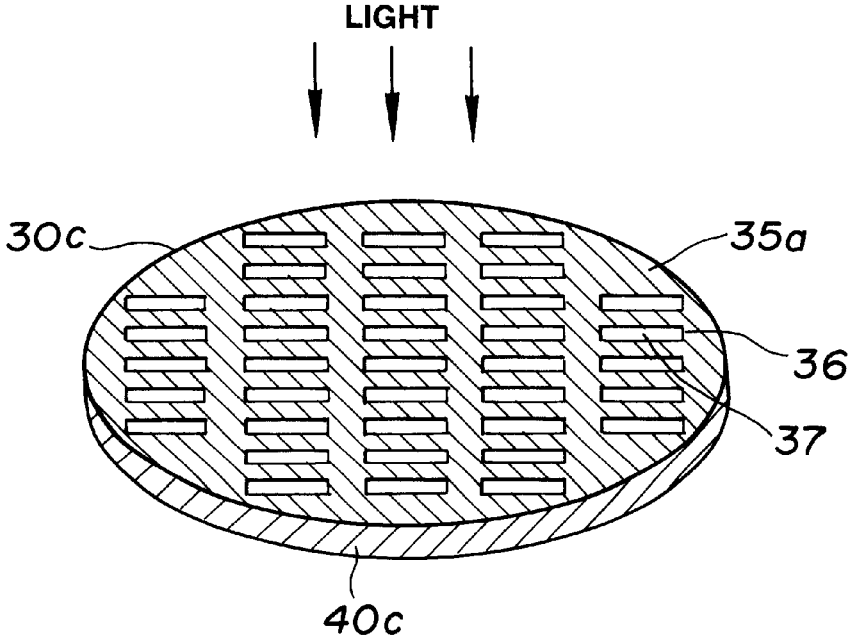

FIGS. 12A and 12B show another variant of the second embodiment. In this variant, a first coloring part 30*b*, 30*c* includes a latticed portion 35, 35*a* made of a material with a first refractive index and having slits 36 filled with a material 37 with a second refractive index. A second coloring part 40*b*, 40*c* is connected to the first coloring part 30*b*, 30*c*. Specifically, referring to FIG. 12A, the first coloring part 30*b* includes latticed portion 35 having a rectangular external form. The plate-like second coloring part 40*b* is connected to the entirety of a long side of the first coloring part 30*b* which is parallel to the longitudinal direction of the slits 36, forming a rectangular section as a whole. The latticed portion 35 and the slits 36 filled with the material 37 form lamellas, respectively.

Referring to FIG. 12B, the first coloring part 30*c* includes latticed portion 35*a* having an elliptical or oval section. The slits 36 are arranged to have the longitudinal direction corresponding to the direction of a major axis of the ellipse. The arc second coloring part 40*c* is connected to a side of the first coloring part 30*c* in the direction of the major axis of the ellipse. According to this variant, forming of a plurality of layer structures contributes to achievement of a deep tone and a high visual quality.

Figure 13A:
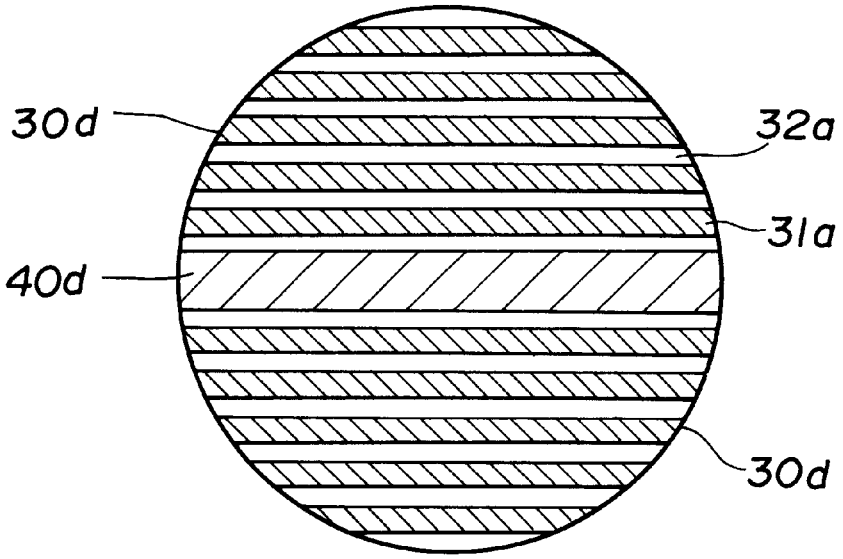
FIGS. 13A and 13B are views similar to FIG. 12B, showing the other variant of the second preferred embodiment.
Figure 13B:
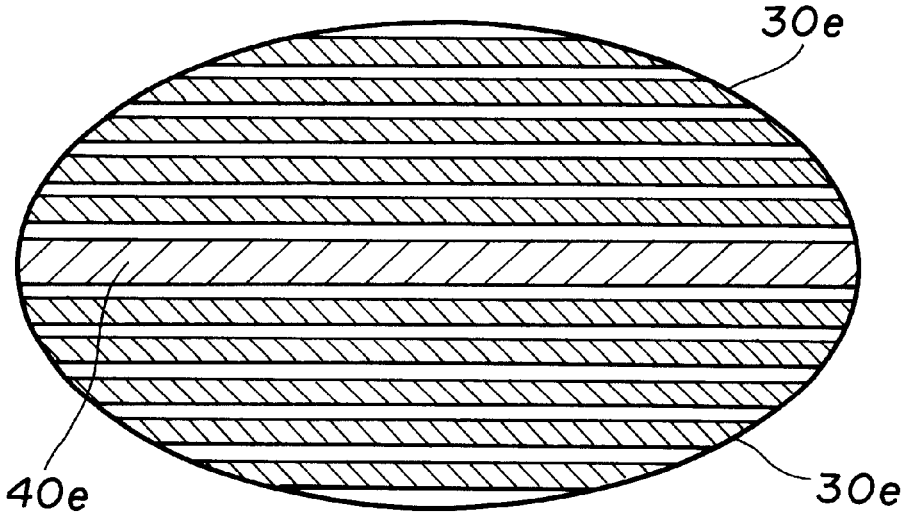

FIGS. 13A and 13B show the other variant of the second embodiment. Referring to FIG. 13A, two first coloring parts 30*d* comprising alternate laminations of substance layers 31*a*, 32*a* with predetermined refractive indexes are arranged on both sides of a second coloring part 40*d*, forming as a whole a circular section with the second coloring part 40*d* disposed substantially in the center thereof. Referring to FIG. 13B, two first coloring parts 30*e* are arranged on both sides of a second coloring part 40*e*, forming as a whole an elliptical or oval section with the second coloring part 40*e* disposed substantially in the center thereof in the direction of a minor axis of the ellipse. According to this variant, effective reflection and interference of light is ensured with respect to light in the direction of two sides of the minute structure.

FIGS. 14–17 show a third embodiment of the present invention. In the third embodiment, for achieving no dependence on the incident direction of light, first coloring parts 50 are radially arranged around a second coloring part 60. Specifically, referring to FIG. 14, a minute structure 3 for producing a color comprises first coloring parts 50 which are radially equidistantly arranged around the second coloring part 60 having a circular section. The first coloring part 50 comprises lamellas 51 disposed in layers and with a predetermined slit or space 53 between two adjacent lamellas, and a core portion 52 extending perpendicularly therethrough and having an end and connected to the second coloring part 60.

In the third embodiment, the lamellas 51 interconnected by the core portion 52 constitute an unit 70 of first coloring part 50. Eight units 70 are radially equidistantly arranged around the second coloring part 60 having a circular section, and are connected to the second coloring part 60. With each unit 70 of first coloring part 50, the length of the lamellas 51 is gradually increased from the lamella 51*a* disposed the nearest to the second coloring part 60 to the lamella 51*b* disposed the most distant therefrom. A material of the first coloring part 50 is a thermoplastic polymer in the same way as the first coloring part 10 in the first embodiment. Moreover, a material of the second coloring part 60 is the same as that of the second coloring part 20 in the first embodiment.

Note that a maximum reflection peak value or reflectivity R of the reflection spectrum of the second coloring part 60 is more than 40%, preferably, more than 60% in view of color perceptibility of viewer's eyes. This corresponds approximately to the lightness more than 4 as described above. Thus, the amount of chromatic coloring matter contained in the second coloring part 60 is adjusted so that the reflectivity or maximum reflection peak value R of the second coloring part 60 is more than 40%.

Figure 15:
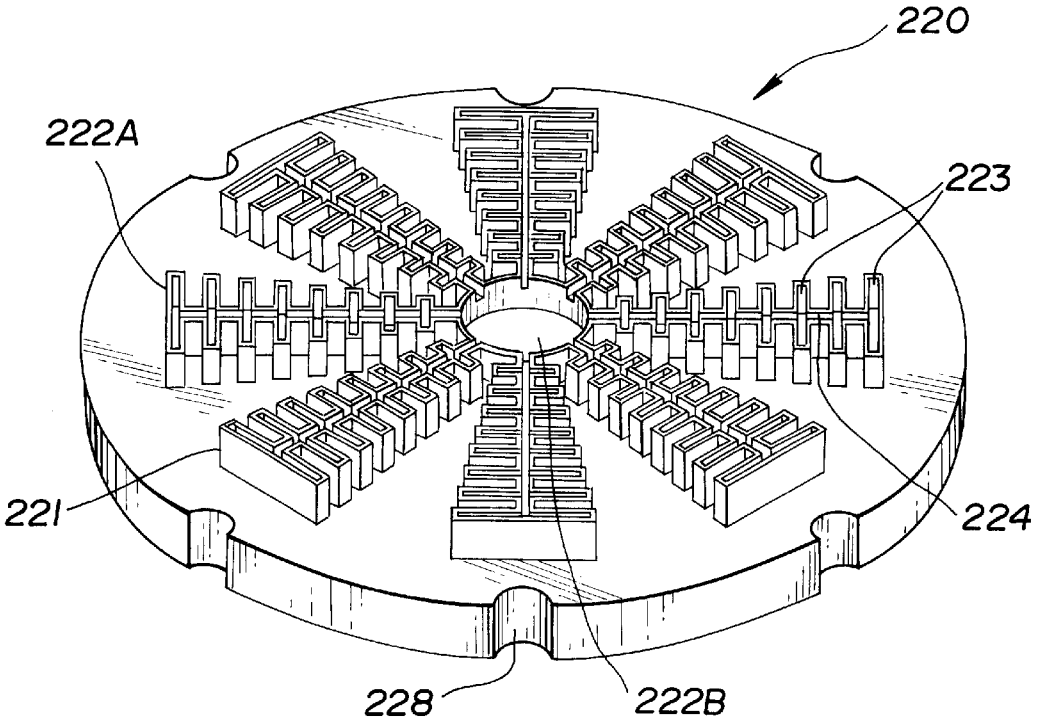
FIG. 15 is a view similar to FIG. 3B, showing a spinneret of the melt spinning device.

The minute structure 3 can be manufactured by a spinneret 220 as shown in FIG. 15 in place of the spinneret 120 as shown in FIGS. 3A–3C. Referring to FIG. 15, the spinneret 220, which is circular as viewed in a plan, includes a partition 221 for controlling island-portion passages which is formed with openings 222A for the first island-portion polymer A arranged radially around a circular opening 222B for the second island-portion polymer B. Each opening 222A includes first slits 223 disposed equidistantly, and a second slit 224 extending radially from the opening 222B to cross the first slits 223 at right angles. The first slits 223 are parallel to each other, the length of which is larger as the distance from the opening 222B is greater. Moreover, the spinneret 220 has openings 228 for the sea-portion polymer C formed at the periphery thereof.

Figure 14:
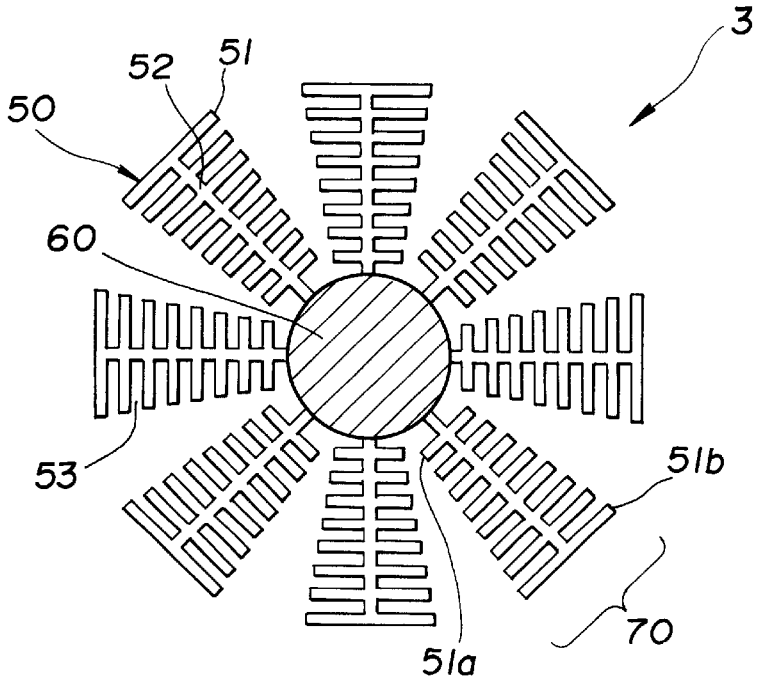
FIG. 14 is a view similar to FIG. 13B, showing a third preferred embodiment of the present invention.
Figure 16:
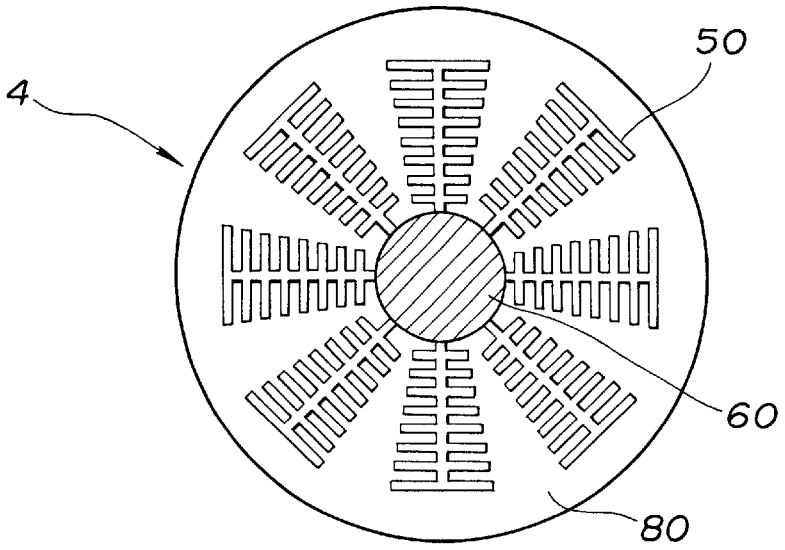
FIG. 16 is a view similar to FIG. 14, showing a filament obtained by the melt spinning device.

The spinneret 220 includes, on the reverse side thereof, a polymer receiving portion communicating with the openings 222A, 222B for the first and second island-portion polymers A, B in the same way as the spinneret 120 as shown in FIG. 2. The spinneret 220 also includes a polymer receiving portion communicating with the opening 228 for the sea-portion polymer C. The spinneret 220 is arranged in a melt spinning device equivalent to the melt spinning device 100 as shown in FIG. 2 to receive, in the polymer receiving portions, the first and second island-portion polymers A, B and the sea-portion polymer C for melt spinning, obtaining an island-in-a-sea type filament 4 as shown in FIG. 16 consisting of a first island portion or first coloring part 50, a second island portion or second coloring part 60, and a sea portion 80 surrounding the two. The sea portion 80 is dissolved by a solvent for its removal from the filament 4, obtaining the minute structure 3 as shown in FIG. 14.

According to the third embodiment, even when contacting a transparent substance with different refractive index, the minute structure 3 has no see-through due to existence of the second coloring part 60. Moreover, due to radial arrangement of a plurality of first coloring parts 50, the minute structure 3 produces a bright tone and a characteristic visual quality by reflection and interference of light regardless of the incident direction thereof.

In the third embodiment, the length of the lamellas 51 is gradually increased from the lamella 51*a* disposed the nearest to the second coloring part 60 to the lamella 51*b* disposed the most distant therefrom, resulting in effective reflection and interference of light incident thereon even with a certain angle, and not perpendicularly. Note that all the lamellas 51 may be the same in length. Also note that the number of units 70 of first coloring part 50, eight in the third embodiment, is preferably as larger as possible to increase the density thereof in the section in view of achievement of substantially the same reflection spectrum and reflectivity regardless of the incident direction of light.

An example of manufacturing the minute structure 3 will be described. The following materials are prepared: pellets of polyethylene terephtalate (PET; refractive index n=1.56) for the first coloring part 50, pellets of polyethylene terephtalate containing as a chromatic coloring matter an organic coloring matter or lead phthalocyanine (green) for the second coloring part 60, and pellets of polystyrene (PS) for the seaportion material for holding the first and second coloring parts 50, 60. The melt spinning device with the spinneret 220 as shown in FIG. 15 is used for spinning. Spinning is carried out at a spinning temperature of 280° C. and a winding speed of 5,000 m/min. The sea-portion polymer C is removed from an island-in-a-sea type filament as obtained by a solvent of methyl ethyl ketone (MEK), obtaining the minute structure 3 as shown in FIG. 14. The thicknesses of a PET layer and air layer of the minute structure 50 are 0.08 $\mu$m and 0.13 $\mu$m, respectively. The total number of layers is 15 (PET: 8; air: 7).

Figure 17:
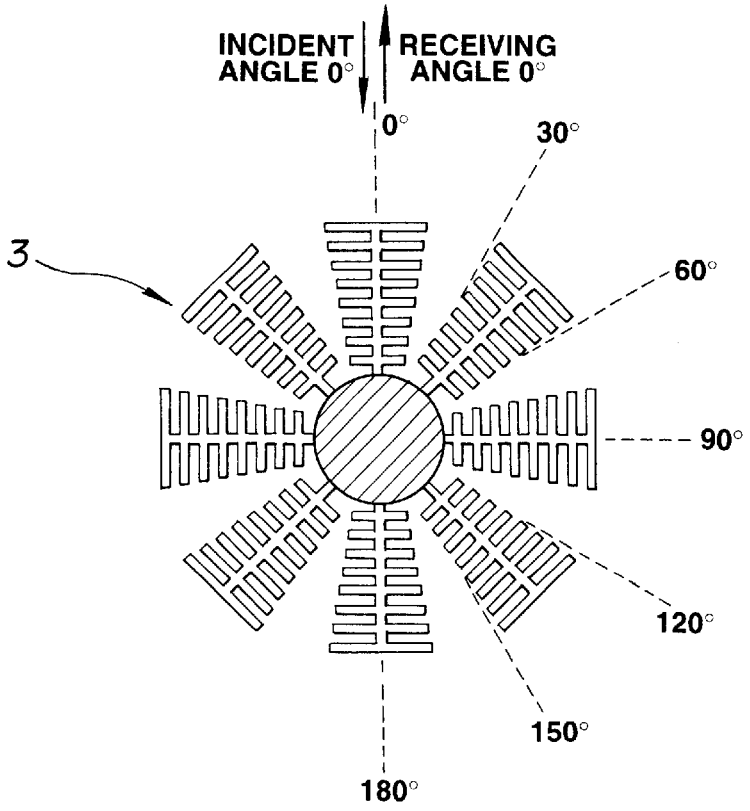
FIG. 17 is a view similar to FIG. 16, illustrating the incident direction of light upon evaluation of coloring of the minute structure.

A color of the minute structure 3 is evaluated in the air and the water. Referring to FIG. 17, upon evaluation in the air, the minute structure 3 is rotated every 30° up to 180° to vary the incident direction of light, a reflection spectrum of which is measured at an incident angle of 0° and a receiving angle of 0° by a microspectrophotometer of Model U-6000 manufactured by Hitachi, Co., Ltd. Upon evaluation in the water, the coloring condition of the minute structure 3 is observed visually.

The results of evaluation are as follows. In the air, with the reflectivity of approximately 80%, the reflection spectrum is obtained having a peak at wavelength of 0.52 $\mu$m at each angle of rotation within a range of 0 to 180°, producing green. The tone and deepness of this green is clearly different from those of green coloring obtained without the second coloring part 60, having a high visual quality. In the water, the minute structure 3 also produces green with no occurrence of see-through.

According to the third embodiment, the minute structure 3 produces a color by reflection and interference of light regardless of the incident direction of light with a bright tone and a characteristic visual quality. Moreover, the minute structure 3 is excellent in practical use due to possible maintaining of its effect even when contacting or being wet with a substance with different refractive index such as a solvent, oil and water.

Figure 18A:
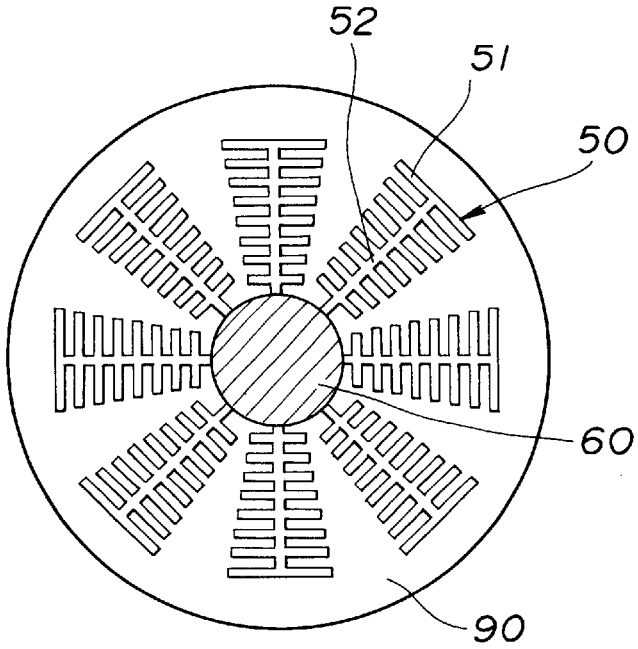
FIGS. 18A and 18B are views similar to FIG. 17, showing a variant of the third preferred embodiment.
Figure 18B:
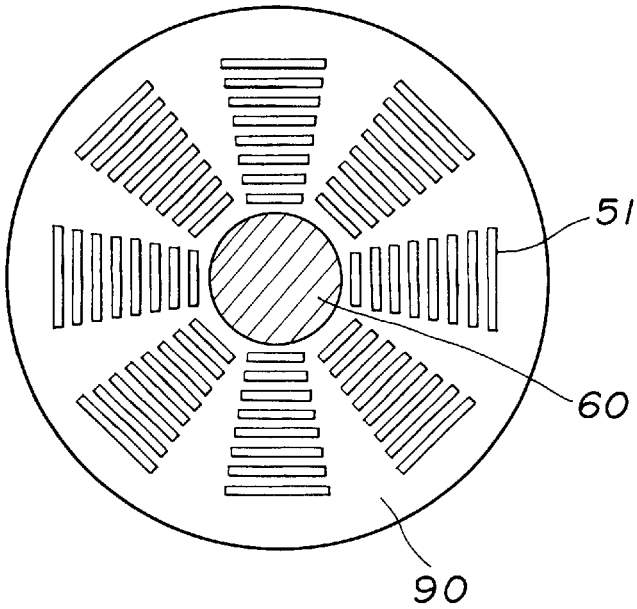

FIGS. 18A and 18B shows variants of the third embodiment. Referring to FIG. 18A, the minute structure is the same in shape as that one as shown in FIG. 16, and comprises first and second coloring parts 50, 60, the periphery of which is filled with a substance 90 with refractive index n≠1.00 in place of air, forming a fiber-like structure with a circular section. Referring to FIG. 18B, the minute structure is substantially the same as that of the variant as shown in FIG. 18A except no existence of the core portion 52 of the first coloring part 50. According to those variants, also, the minute structure produces a color by reflection and interference of light regardless of the incident direction of light, having various tones without lowering of brightness, clearness and deepness. Moreover, the minute structure is excellent in practical use due to no quality deterioration by the influence of an external environment such as contact with a substance with different refractive index.

Figure 19:
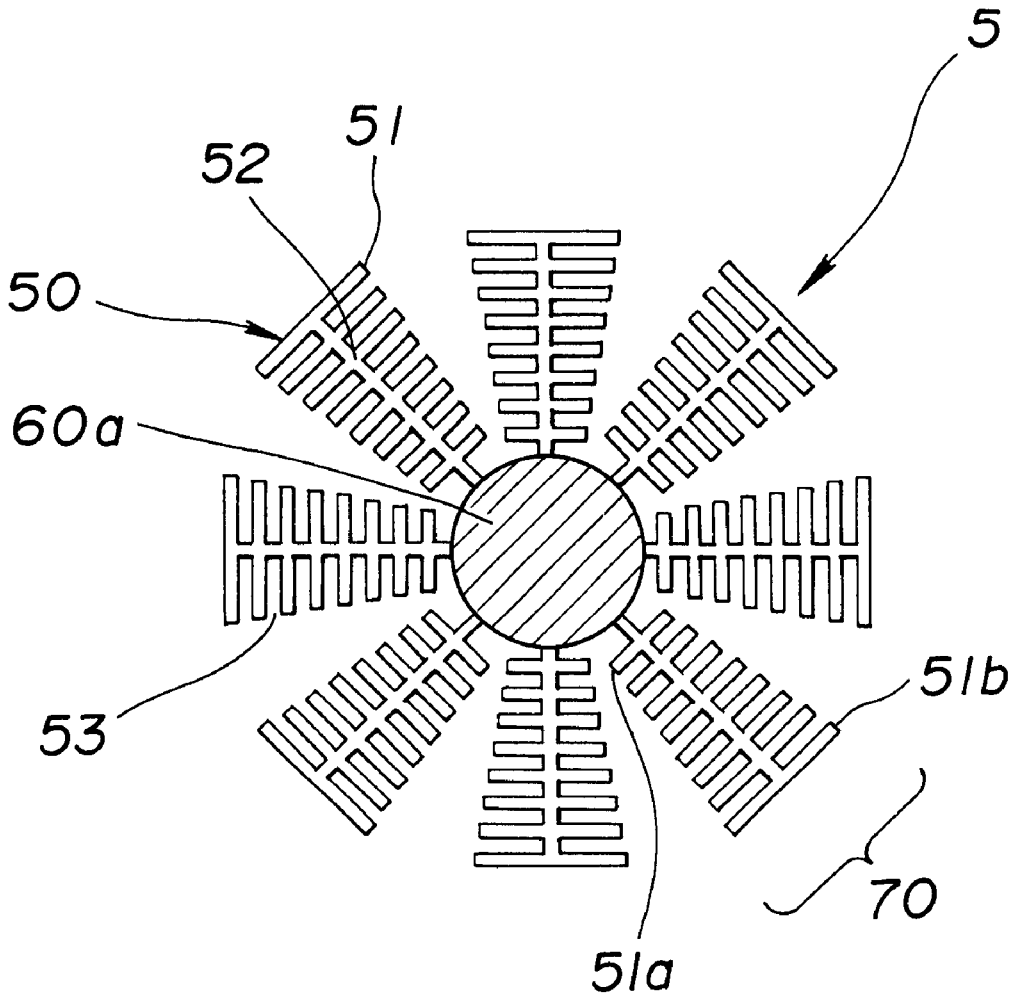
FIG. 19 is a view similar to FIG. 18B, showing a fourth preferred embodiment of the present invention.

FIG. 19 shows a fourth embodiment of the present invention. The structure of the fourth embodiment is substantially the same as that of the third embodiment as shown in FIG. 14 except that a second coloring part 60*a* of a minute structure 5 contains an achromatic coloring matter having uniform absorption in the visible light area. Note that the "achromatic coloring matter" is such as to show uniform absorption, i.e. have practically no reflection in the visible light area, including principally black and grey coloring matters. As for the definition of "achromatic color", see, e.g. Japanese Industrial Standard Z8105 "Terminology for Colors". Examples of achromatic coloring matters are carbon black (C), iron oxide black (Fe304), zinc white (ZnO), etc. as inorganic coloring matters or pigments, and aniline black, etc. as organic coloring matters. According to the fourth embodiment, light incident on the minute structure 5 is subjected to reflection and interference at units 70 located on the side of a plane of incidence, given wavelengths of which are perceived by viewer's eyes as a color. The units 70 are radially arranged around the second coloring part 60*a*, allowing coloring regardless of the incident direction of light.

As described above, in an environment with air layer, the first coloring part 50 receives light incident on the minute structure 5, producing a color with wavelength determined in accordance with the interference condition. If reflection on the first coloring part 50 is a total reflection, light does not reach the second coloring part 60*a*, so that only the first coloring part 50 is active in coloring, producing a bright tone and a characteristic visual quality. On the other hand, if reflection on the first coloring part 50 is not a total reflection, but, e.g. approximately 50% in reflectivity, a part of the rest of light is scattered, and another part of the rest of light penetrates the first coloring part 50, and reaches the second coloring part 60*a*. When being reflected thereby, another part of the rest of light operates as stray light with various wavelengths, which may harm a bright color derived from the first coloring part 50. However, according to the fourth embodiment, such stray light and penetrating light are absorbed by the second coloring part 60*a* containing an achromatic coloring matter, so that viewer's eyes perceive a bright color derived from the first coloring part 50 without being decreased by half.

Likewise, when an periphery of the minute structure 5 is filled with a transparent substance with equivalent refractive index, the first coloring part 50 is out of the interference condition, allowing most of incident light to reach the second coloring part 60*a* according to the condition. However, according to the fourth embodiment, light reaching the second coloring part 60*a* is subjected to absorption in the whole visible light area by an achromatic coloring matter contained therein, which is perceived by viewer's eyes as black with no occurrence of see-through.

An example of manufacturing the minute structure 5 will be described. The following materials are prepared: pellets of polyethylene terephtalate (PET; refractive index n=1.56) for the first coloring part 50, pellets of polyethylene terephtalate containing as an achromatic coloring matter aniline black (black) of an organic coloring matter for the second coloring part 60*a*, and pellets of polystyrene (PS) for the sea-portion material for holding the first and second coloring parts 50, 60*a*. The melt spinning device with the spinneret 220 as shown in FIG. 15 is used for spinning. Spinning is carried out at a spinning temperature of 280° C. and a winding speed of 5,000 m/min. Then, the sea-portion polymer C is removed from an island-in-a-sea type filament as obtained by a solvent of methyl ethyl ketone (MEK), obtaining the minute structure 5 as shown in FIG. 19. The thicknesses of a PET layer and air layer of the minute structure 5 are 0.08 μm and 0.15 μm, respectively. The total number of layers is 15 (PET: 8; air: 7).

A color of the minute structure 5 is evaluated in the air and the water. Upon evaluation in the air, in the same way as in the example in the third embodiment, the minute structure 5 is rotated every 30° up to 180° to vary the incident direction of light, a reflection spectrum of which is measured at an incident angle of 0° and a receiving angle of 0° by a microspectrophotometer of Model U-6000 manufactured by Hitachi, Co., Ltd. Upon evaluation in the water, the coloring condition of the minute structure 5 is observed visually.

The results of evaluation are as follows. In the air, with the 5 reflectivity of approximately 85%, the reflection spectrum is obtained having a peak at wavelength of 0.48 μm at each angle of rotation within a range of 0 to 180°, producing blue. The tone and deepness of this blue is clearly different from those of blue coloring obtained without the second coloring part 60*a*, having a high visual quality. In the water, the minute structure 5 produces a dark color or black with no occurrence of see-through.

Note that, in the same way as the variants of the third embodiment as shown in FIGS. 18A and 18B, the fourth embodiment can be constructed such that the periphery of the first and second coloring parts 50, 60*a* is filled with a substance with refractive index n≠1.00, or only the lamellas 51*a* re disposed radially and in layers in a substance with refractive index n≠1.00 placed at the periphery of the second coloring part 60*a*.

In the fourth embodiment, the first coloring part 50 which produces a color resulting from its layer structure may contain an achromatic coloring matter. However, kinds of pigments and content thereof can cause an increase in absorption in the visible light area, so that light incident on the minute structure 5 reaches the lower lamellas 51 insufficiently. In view of possible deterioration of coloring of the first coloring part 50 due to the above fact, the first coloring part 50 contains preferably no achromatic coloring matter.

In the above embodiments wherein the second coloring part contains a chromatic coloring matter, the first coloring part which produces a color resulting from its layer structure is constructed to have optical penetrability, but not constructed particularly to contain a chromatic coloring matter. As described above, kinds of pigments and content thereof can cause an increase in absorption in the visible light area. However, considering attenuation of light incident on the first coloring part due to the above absorption, the first coloring part can be constructed to contain a chromatic coloring matter within predetermined limits, producing a color in a certain extent.

Moreover, in the above embodiments, the minute structures for producing colors are formed like a fiber. Alternatively, the minute structures may be formed like a chip, which are obtained, e.g. by shredding filaments of the minute structures for addition to coating materials. Moreover, the minute structures described in connection with the variants of the first embodiment as shown in FIGS. 7–9B and those of the second embodiment as shown in FIGS. 11–13B may be spread on two or three dimensional surfaces with the second coloring parts being disposed thereon, which are usable for car coating, etc.

What is claimed is:

1. A minute structure for producing a color, comprising:

at least one first part, said first part producing a first color with first wavelengths in a visible light area by physical actions, said first part including lamellas disposed in layers at predetermined intervals; and a second part disposed adjacent to said first part, said second part absorbing a part of light with second wavelengths in said visible light area and reflecting the rest of light, said second part comprising a coloring compound.

2. A minute structure as claimed in claim 1, wherein said first part includes a portion for interconnecting said lamellas.

3. A minute structure as claimed in claim 2, wherein said first part is connected to said second part through said interconnecting portion.

4. A minute structure as claimed in claim 1, wherein said first part comprises a thermoplastic polymer.

5. A minute structure as claimed in claim 1, wherein said first and second parts are formed to have a predetermined shape.

6. A minute structure as claimed in claim 1, wherein said coloring matter of said second part comprises a chromatic coloring compound.

7. A minute structure as claimed in claim 6, wherein said chromatic coloring compound comprises at least one inorganic or organic chromatic coloring compound.

8. A minute structure as claimed in claim 7, wherein said inorganic chromatic coloring compound comprises at least one of:

an oxide selected from the group consisting of iron oxide red ($Fe_2O_3$), zinc white (ZnO) and chromium oxide ($Cr_2O_3$), hydroxide selected from the group consisting of chrome yellow ($PbCrO_4$), viridian and alumina white, a sulfide selected from the group consisting of cadmium red (CdS.CdSe) and cadmium yellow (CdS), or a chromic acid selected from the group consisting of chrome yellow and zinc chromate.

9. A minute structure as claimed in claim 7, wherein said organic chromatic coloring compound comprises at least one of:

an azo compound, a phthalocyanine compound, a condensed polycyclic compound selected from the group consisting of perylene, quinacridone and thioindigo, or a pteridine compound.

10. A minute structure as claimed in claim 1, wherein said second part is constructed so that a maximum reflection peak value of a visible light reflection spectrum thereof is more than 40%.

11. A minute structure as claimed in claim 1, wherein said second part is constructed so that a maximum reflection peak value of a visible light reflection spectrum thereof is more than 60%.

12. A minute structure as claimed in claim 1, wherein said first part is connected to said second part through one of said lamellas.

13. A minute structure as claimed in claim 1, wherein an outermost lamella of said lamellas disposed in layers includes a protrusion.

14. A minute structure as claimed in claim 1, wherein said lamellas comprise first and second lamellas, and wherein said first and second lamellas have different refractive indexes disposed alternately.

15. A minute structure as claimed in claim 1, wherein said first part includes a portion surrounding said lamellas, the refractive index of said portion being different from that of said lamellas.

16. A minute structure for producing a color, comprising:

at least one first part, each first part producing a first color with first wavelengths in visible light by at least one of reflection, interference, diffraction or light scattering, each first part including lamellas disposed in layers at predetermined intervals; and a second part disposed adjacent to said first part, said second part absorbing light possessing second wavelengths in said visible light and reflecting light not possessing said second wavelength, said second part comprising a coloring compound, said first parts being radially disposed around said second part.

17. A minute structure as claimed in claim 16, wherein said lamellas of each first part have a length increased gradually to an outermost of said lamellas disposed in layers.

18. A minute structure as claimed in claim 16, further comprising:

a third part surrounding said first and second parts, said third part having a predetermined refractive index.

19. A minute structure as claimed in claim 18, wherein said predetermined refractive index of said third part is not 1.00.

20. A minute structure as claimed in claim 16, wherein said coloring compound of said second part comprises an achromatic coloring compound.

21. A minute structure for producing a color, comprising:

means for producing a first color with first wavelengths in a visible light area by physical actions, said producing means including lamellas disposed in layers at predetermined intervals; and means disposed adjacent to said producing means for absorbing a part of light with second wavelengths in said visible light area and reflecting the rest of light, said absorbing means containing a coloring compound.

22. A minute structure which is capable of producing a compound color comprising:

a first coloring part producing a first color, a second part adjacent to said first part and comprising a chromatic coloring compound which reflects light at particular wavelengths, said second part being configured such that when said stray light emitted from said first part penetrates said second part, at least a portion of said stray light is emitted at a wavelength of said chromatic coloring compound to produce a second color.

* * * * *